United States Patent [19]

Salvino

[11] 4,106,694

[45] Aug. 15, 1978

[54] PREFABRICATED RAIL BASE UNIT CONSISTING OF A PLURALITY OF PROJECTIONS AND A SINGLE CONTINUOUS SLAB

[76] Inventor: Santo Salvino, 117 Via dei Glicini, Rome, Italy

[21] Appl. No.: 704,808

[22] Filed: Jul. 13, 1976

[51] Int. Cl.[2] ..... E01B 3/38

[52] U.S. Cl. ..... 238/10 C; 238/85; 238/265; 238/283; 238/350

[58] Field of Search ..... 238/6, 7, 29, 83–85, 238/264–265, 283, 310, 349–350, 2, 10 R, 10 A, 10 B, 10 C, 91, 92, 94, 24–26; 104/3

[56] References Cited

U.S. PATENT DOCUMENTS

| | | | |
|---|---|---|---|
| 1,066,767 | 7/1913 | Tebyrica | 238/6 |
| 1,413,983 | 4/1922 | Griewank | 238/7 |
| 1,426,828 | 8/1922 | Farnham | 238/92 |
| 1,435,074 | 11/1922 | Lott | 238/265 |
| 2,367,146 | 1/1945 | Siebs | 238/7 |
| 2,844,325 | 7/1958 | Weber et al. | 238/7 |
| 3,762,641 | 10/1973 | Schubert | 238/10 R |

FOREIGN PATENT DOCUMENTS

| | | | |
|---|---|---|---|
| 108,727 | 10/1939 | Australia | 238/85 |
| 388,556 | 3/1908 | France | 238/91 |
| 2,354,960 | 5/1975 | Fed. Rep. of Germany | 238/7 |
| 466,155 | 5/1937 | United Kingdom | 238/85 |

OTHER PUBLICATIONS

American Concrete Crosstie Corporation, Sales Brochure Dec. 7, 1959, Box 11476 Tampa, Fla., pp. 4 & 5.

*Primary Examiner*—Drayton E. Hoffman
*Assistant Examiner*—Carl Rowold
*Attorney, Agent, or Firm*—Toren, McGeady and Stanger

[57] ABSTRACT

A railroad bed assembly for supporting thereon metallic railroad tracks is formed with a base structure which consists essentially of reinforced concrete made as prefabricated blocks with the base structure including a slab section adapted to be installed over a ground formation at the railroad bed site and with at least one upwardly extending projection running transversely to the direction of the tracks and having a trapezoidal cross sectional configuration taken in a plane extending parallel to the tracks. The projection and the slab are integrally formed of prestressed concrete material and the projection extends to form a cross tie for supporting thereupon the tracks.

9 Claims, 29 Drawing Figures

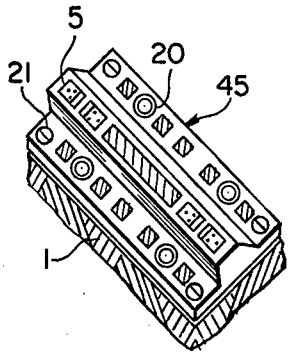
FIG. 21
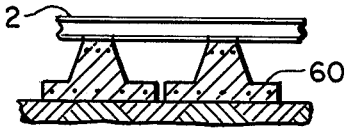
FIG. 21A
FIG. 22
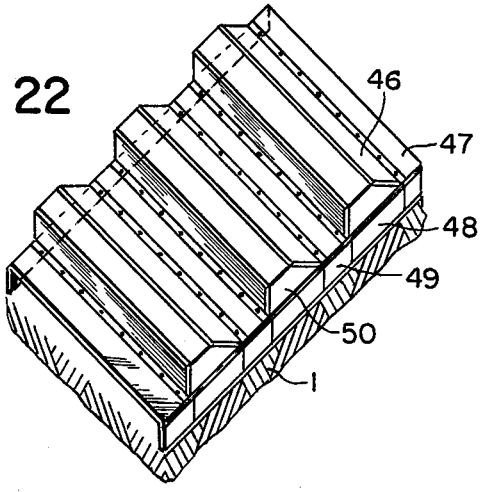
FIG. 23
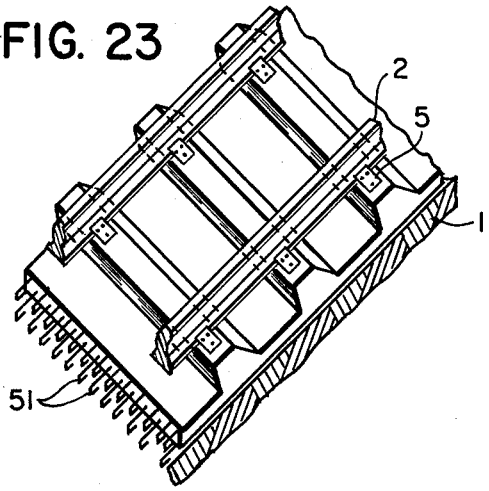
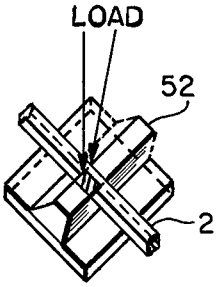
FIG. 24
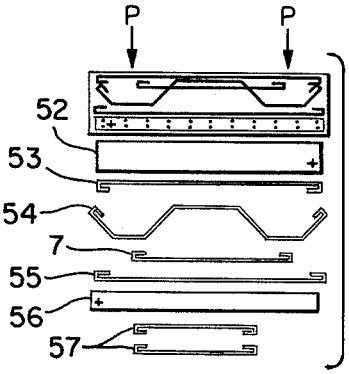
FIG. 25
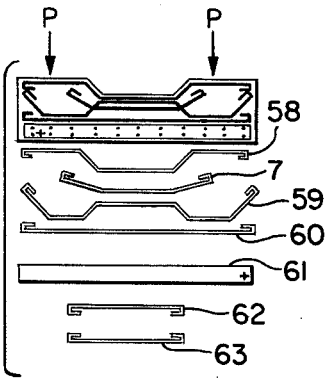
FIG. 26
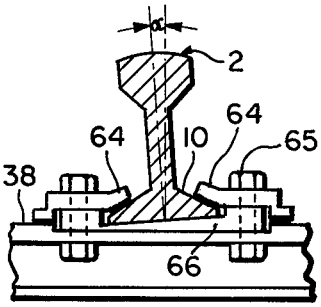
FIG. 27

PREFABRICATED RAIL BASE UNIT CONSISTING OF A PLURALITY OF PROJECTIONS AND A SINGLE CONTINUOUS SLAB

The object of the present invention is the construction of a base on which the track bed of metal or concrete rests, whose structure can be continuous or in prefabricated blocks with one or more transverse projections of trapezoidal section, which can be adapted to all dimensions of rail, tram or underground lines. Part of the invention is constituted by the process for the carrying out of said structure when the traditional superstructure is to be exchanged with that of the present invention without interruption of the operation of the line.

As is known, rail transport is still based on the structure of wooden sleepers on prestressed concrete or on concrete slabs, on which the wooden sleepers rest.

Such traditional structures present the following disadvantages:

(a) reduction of speed caused by the lack of stability of the structure of the rail base;
(b) complex and expensive periodic checks and maintenance operations because of:
  (1) imperative frequent inspections, checking and replacement of structure material;
  (2) filling up of gaps between the rails;
  (3) rectification of the level and the packing of the sleepers;
  (4) re-alignment of rails;
  (5) increased work for replacing the wooden sleepers;
  (6) general revisions to be carried out as a rule every 7 or 8 years;
(c) the lack of greater safety due to the instability of the rails which are not fastened to a stable base, thus causing skidding of the railway vehicles, as can be seen from the statistical data.

SCOPE OF THE NEW INVENTION

The scope of the invention is to create a metal or reinforced concrete structure for the support of continuous or prefabricated rail tracks suitable for any kind of rail, tram and underground transport suitable for all national and international areas.

ADVANTAGES OF THE NEW INVENTION

According to the invention the structure of the continuous or segmented rail base has the following advantages:

(1) because of its excellent characteristics it has the duration of several centuries;
(2) it permits the vehicle to reach a higher speed than 250 km/h;
(3) it resists small shocks of earthquakes;
(4) it resists any kind of landslide;
(5) during the war it resists smaller bombing;
(6) it permits the exchange of sleepers;
(7) it svoids skidding of the rail cars;
(8) it confers greater stability of the load on the rails;
(9) it permits saving of capital in the future. The saving of capital in the future with respect to the presently installed tracks, will permit:
(a) the decrease of expenditure for maintenance;
(b) the necessary checking of the replacement of the superstructure material;
(c) the replacement of the sleepers;

(d) the necessary general inspection which has to be carried out regularly every 7 or 8 years.

This structure according to the invention is used for those sections of the line where a prefabricated one cannot be installed because of mural or other structures.

According to the invention, the structure is prefabricated blocks with two or three projections affords almost the same security and stability as the one of the base of the continued structure due to the fastening of the structure itself on the ground by means of ties of prestressed concrete, as will be explained more accurately hereunder;

This structure presents other advantages with respect to the continuous structure:

(a) the construction of prefabricated blocks in areas near the place of installation;
(b) less time needed for and rapid construction of a new line;
(c) very little time required to substitute the old structure (i.e. wooden sleepers with the one of the new invention.

According to this invention the structure with only one projection, incorporated in the very slab, offers the same security and stability as the prefabricated one with two or more projections, because also said slab is fastened to the ground by ties in prestressed concrete; it also affords other advantages with respect to the continuous or prefabricated structure with two or more projections:

(a) a more easy handling at installation, due to the lesser weight and volume;
(b) very little time to exchange the sleepers;
(c) a minimum of equipment for the prefabricated construction of same as well as for their installation;
(d) construction of the structure in areas near installation.

According to the invention, the prefabricated structure in precompressed concrete presents the same stability as the other structures and facilitates the exchange of the wooden sleepers, because of its characteristics with respect to height and minimal weight; at any rate it permits a reduction of height of 30–35% between the plane of the track laying and the base of the rail with respect to the other structures of normal types of reinforced concrete.

The height "*h*" between the plane of track laying and the rail base (FIG. 2) is of course variable according to the effective load, the characteristics of the ground and the quality of the materials used in the structure and of their treatment (prestressed concrete). To give an example, the height of the sleeper in reinforced concrete for the Italian underground rails varies from 18–20 cm, while the linear meter weighs 300 to 320 kg.

In conclusion, this invention avoids vibration between the rails and the underlying base, it confers more stability ad greater economy with respect to other existing structures, and facilitates the packing of the rail base should the underlying ground give way.

The flexibility of the above-mentioned structure is divided up between the ground, the structure in reinforced concrete and the plastic antivibrating material.

BRIEF DESCRIPTION OF THE DRAWINGS

In the drawings:

FIG. 21 is a perspective view of a prefabricated sleeper;

FIG. 21A is a sectional view of a sleeper;

FIG. 22 is a perspective view of a mold;

FIG. 23 is a perspective view of a finalized segment;

FIG. 24 is a schematic perspective view for exemplary purposes;

FIGS. 25 and 26 are exploded type views showing various parts of an assembly; and FIG. 27 is a sectional view of a supporting girder assembly.

SPECIFICATION OF THE FIGURES

Figure 1:
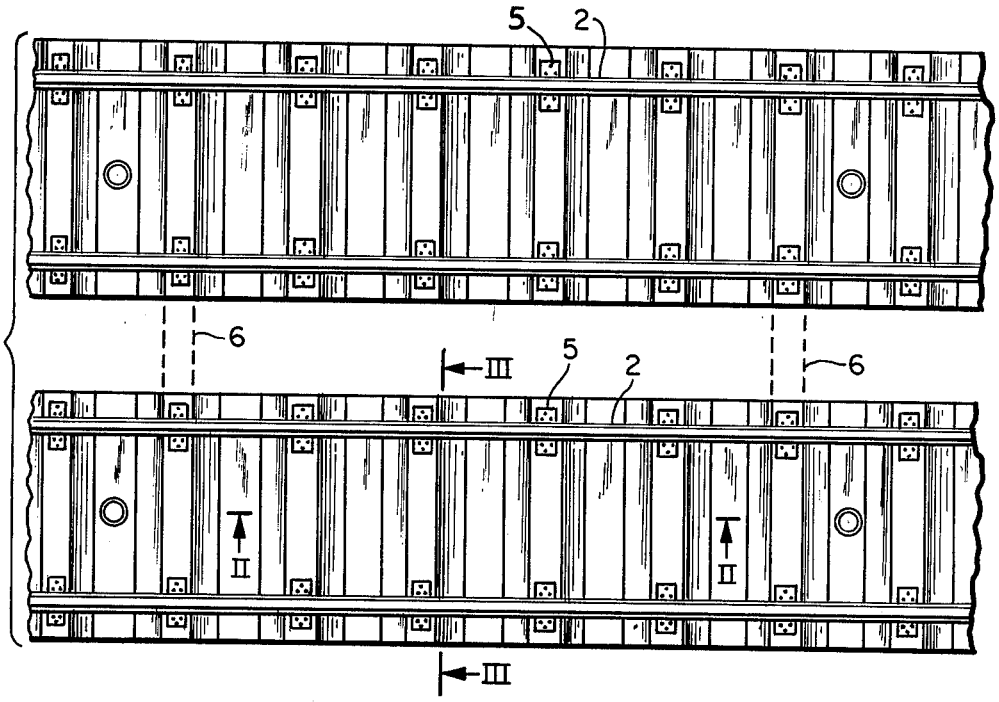
FIG. 1 is a top view of a double rail section constructed in accordance with the present invention.

FIG. 1 is a top view of a double rail section, whose rail base structure may be continuous or segmented, 2 indicates the rail, 5 is a mechanical element for fastening, partly incorporated in the concrete structure and partly mobile, which serves to block the base of the rail on the base structure; 6 (in dotted lines) indicates a connecting bar in reinforced concrete between two lines, the distance of which varies on the basis of the geological structure of the ground.

Figure 2:
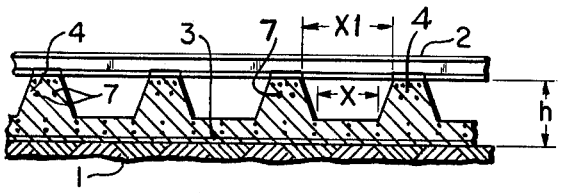
FIG. 2 is a section view taken along the line II—II of FIG. 1.

The above-mentioned structure is composed of a continuous slab or a segmented slab in reinforced concrete on the plane of the mold with a series of transverse projections with a trapezoidal cross section integral therewith, as described in FIG. 2, forming a unitary body with the above-mentioned slab and mechanical ties and joints intended to fasten the rails in the described position to the respective body in reinforced concrete.

FIG. 2 is a cross-section view according to plane II—II of FIG. 1; where 1 indicates the laying plane, i.e. the plane on which the base of the structure rests; 3 is the continuous or segmented slab; 4 indicates one of the transverse projections with trapezoidal section, 7 indicates two rodcrops for joining the two mechanical fastening elements indicated with 5; "*h*" is the height between the laying plane and the rail base which varies according to the load on the rail and the quality of the material; section XI can vary from 60 to 120 cm on the basis of the effective load and of the technological composition of the rails, while X varies in accordance with the value of XI.

Figure 3:
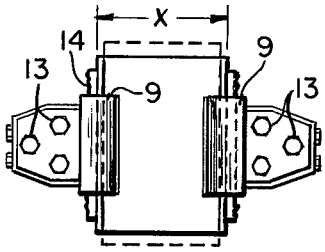
FIG. 3 is a top view of a detail of the invention.

FIG. 3 is a top view of the mechanical fastening element without the rail; 9 indicates the jaws which serve to tie by means of bolts 13 the foot of the rail to the base; 14 indicates the stirrup-piece with the plane on which the rail base rests.

Said element, besides holding the plastic antivibrating material, has been elaborated for the purpose of absorbing the transverse pressure forces which are created by the passage of the movable load.

Figure 4:
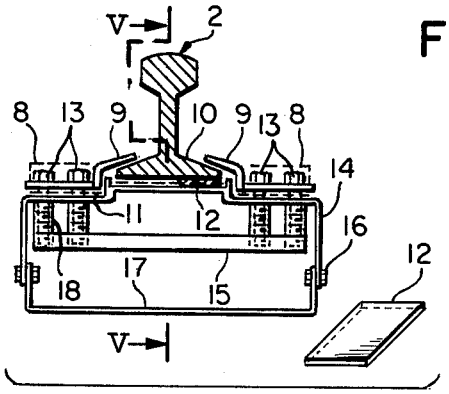
FIG. 4 is a sectional view of a portion of an embodiment of the invention.

FIG. 4 shows an enlargement of the details of one of the mechanical fastening elements in a perspective view which can be adapted both to the structure of the continuous as well as the prefabricated base. The element, besides conferring a greater stability and security in fastening the rail base to the base structure, permits the substitution of the rails in a very short time. The rail is indicated with 2, 8 indicates, in dotted lines, a protection cap; 9 are two jaws; 11 shows some steel shims for the fastening of the jaw 9 at the base of the rail indicated with 10; 12 indicates an antivibrating plastic washer (or other suitable technological material) which is interposed between the stirrup-piece 14 and the base of the rail 10; 15 indicates a small metal shaft soldered to threaded journal boxes 18, into which the bolts 13 are screwed. 17 indicates a small shaped metallic bar fastened by means of small perforated bolts 16 to the upper stirrup 14. The small shaped bar, part of the stirrup-piece, the threaded journal boxes and soldered stripes constitute a sole body with the reinforced concrete, as can be seen from FIG. 7.

Figure 5:
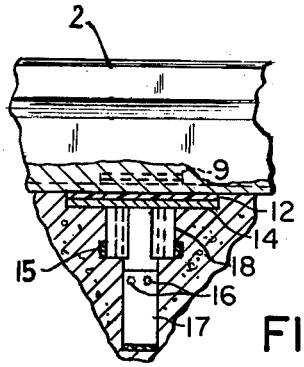
FIG. 5 is a sectional view taken along the line V—V of FIG. 4.

FIG. 5 indicates the section along the line V—V of the mechanic fastening element shown in FIG. 4; 2 indicates the rail; 9 the jaws; 12 an antivibrating plastic shim; 14 the stirrup-piece; 18 the threaded journal boxes; 17 the small lower stirrup which is joined to the upper stirrup-piece by perforated bolts indicated by reference number 16.

Figure 6:
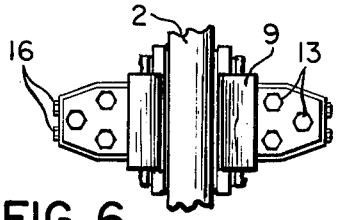
FIG. 6 is a plan view of a portion of the device shown in FIG. 4.
Figure 7:
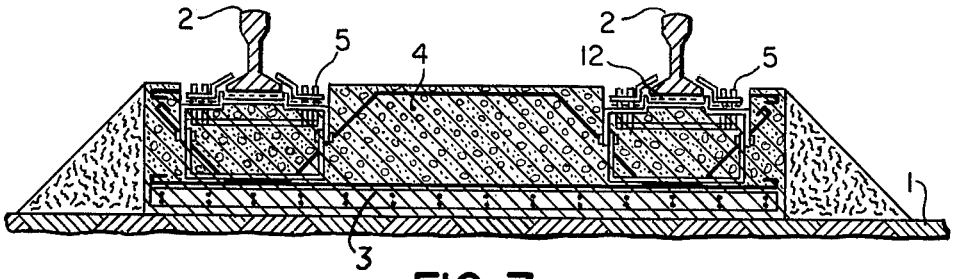
FIG. 7 is a sectional view taken along the line III—III of FIG. 1.

FIG. 6 shows a bird's eye view of the mechanic fastening element of FIG. 4 with the rail; 2 indicates the rail; 9 the jaws; 13 indicates the fastening bolts;

FIG. 7 shows an enlarged transversal section along the line III—III of FIG. 1, with the lay-out of the iron elements, of the reinforced concrete, of the two rail-fastening elements; 1 indicates the laying plane; 2 the rails; 3 the base; 4 the transverse section of the trapezoidal projection; 5 the mechanic fastening elements.

Figure 8:
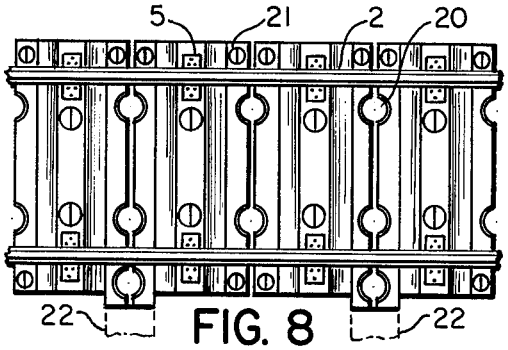
FIGS. 8–11 are plan views of rail sections which may be formed in accordance with the invention.
Figure 9:
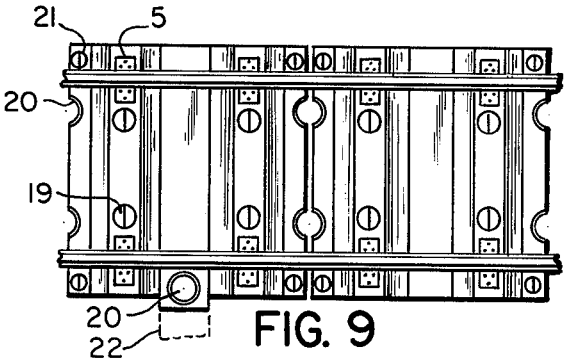
Figure 10:
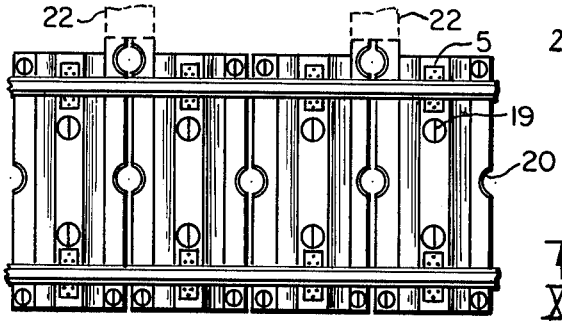

FIGS. 8–10 indicate a bird's eye view of two segments of prefabricated rails of several bases with single projections with connecting sleepers 22 also prefabricated, the distance of which from one another varies in accordance with the geological structure of the ground; 2 indicates the rail; 20 indicates the opening into which is inserted the rod lock in reinforced concrete. In the joint sleepers indicated with 22 two openings 20 are shown into which the locks in reinforced concrete are inserted. This number of the above-mentioned locks is used for the fastening of the prefabricated structures on the ground and they vary both in accordance with the geological structure of the ground and the speed of the train. The rings with a diametric section are indicated with 19 and 20; these are shown in all prefabricated block structures and serve to handle these blocks by technical hooks, both for transport as well as for the installation.

Figure 11:
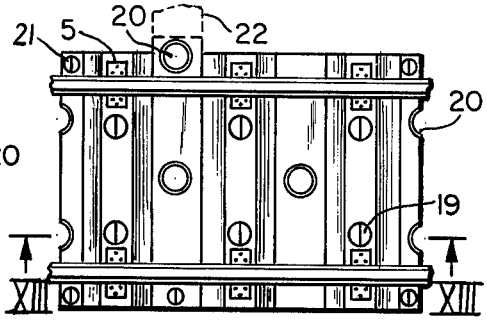

FIGS. 9–11 indicate: the first (FIG. 9) a bird's eye view of a rail segment with bases of two projections and the other (FIG. 11) a bird's eye view of a rail segment with bases of three projections; while the reference numbers 5-19-20-21-22 indicate the same already quoted elements in FIGS. 8-10.

Figure 12:
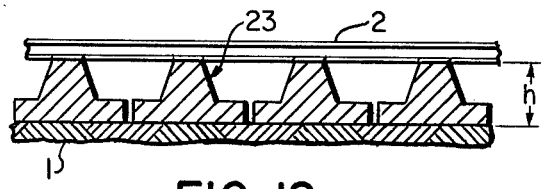
FIGS. 12 and 13 are sectional views of further embodiments of the invention.

FIG. 12 shows a lateral view of a prefabricated structure with a single projection; 2 indicates the rail; 23 the front surface of the sleeper; "*h*" indicates the height between the installation plane and the rail base.

Figure 13:
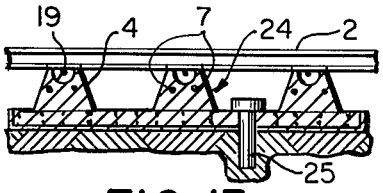

FIG. 13 represents the section according to the line IV—IV of FIG. 11 of the prefabricated block with three projections; 2 indicates the rail; 4 the transversal projection with a trapezoidal section; 7 shows two rod crops which connect the two mechanical fastening elements; 19 the form of the small ring in section; 24 is the prefabricated block; 25 the lock in reinforced concrete for fastening the block to the ground.

Figure 14:
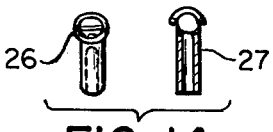
FIG. 14 is a schematic view of a fastening element.

FIG. 14 shows a fastening lock shaped as a rod in reinforced concrete, suited to fasten the structure on the ground; 26 indicates a ring with a steel crop of 14 mm which will serve for the removal of the lock in case of dismantling the structure; 27 indicates the lock in section.

Figure 15:
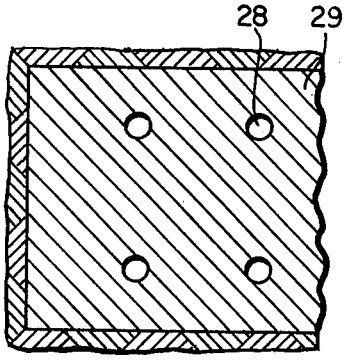
FIG. 15 is a plan view of an installation plane.

FIG. 15 shows a section of the installation plane prepared for the construction of a new line with prefabricated blocks; 29 indicates the installation plane while 28 is the opening into which the extension of the fastening lock is introduced. Said installation plane must be levelled with concrete and is used in the case of less compact soil.

Figure 16:
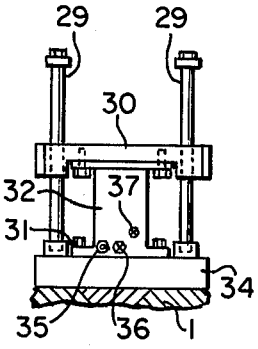
FIGS. 16 and 17 are sectional views of hydraulic means which may be used with the invention.
Figure 17:
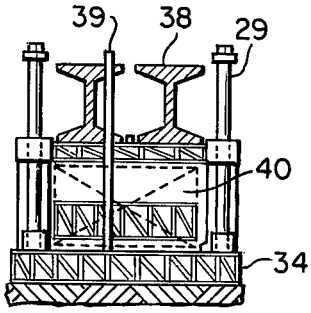

FIGS. 16-17 indicate the structure of a new hydraulic jack used for hoisting the girder or other elements; 29 indicates the supporting columns; 30 the support plane; 31 the bolt for fastening the cylinder; 32 the cylinder; 34 the base; 35 the connection for the inlet and the outlet of the oil; 36 the opening and closing valve of the oil outlet; 37 the safety and discharge valve; 38 the supporting girder; 39 the metal rod for the support of the jack and the girder; 40 the space for the insertion of the calibrated shims which can vary from 1-50 mm.

Figure 18A:
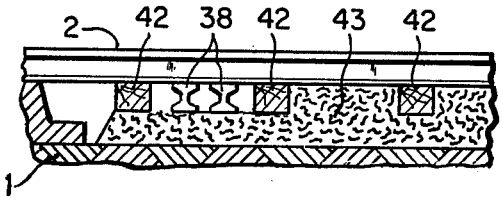
FIGS. 18A and 18B are sectional views illustrating an exchange process.
Figure 18B:
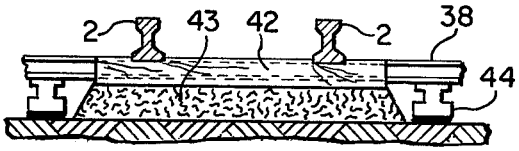
(PRIOR ART) FIG. 18B

FIG. 18 illustrates the process for the exchange of the traditional superstructure with the one of the present invention without interruption of the operation of the line; 2 indicates the rails; 38 the supporting girders; 42 the wooden sleepers; 43 the ballast; 44 the jack.

Process: The ballast between two sleepers is removed until the lower plane is reached; the provisional supporting girders 38 which are longer than the sleepers 42 are inserted under the rails 2; the provisional girders are placed incorporating them in the rails with calibrated shims (see FIG. 27); the lateral parts are excavated until the plane of the platform is reached; the jacks 44 described in FIGS. 16 and 17 are placed at the ends of the girders; the jacks are put into action until they reach the lower part of the supporting girders 38 inserting the calibrated shims into the dotted part indicated with 40 in the FIG. 17; the hydraulic pressure is let out from both parts of the jack and the dismantling of the central part of the ballast, indicated with 43 is completed; the space necessary for the installation of the continuous or prefabricated structure is therefore obtained.

Figure 19:
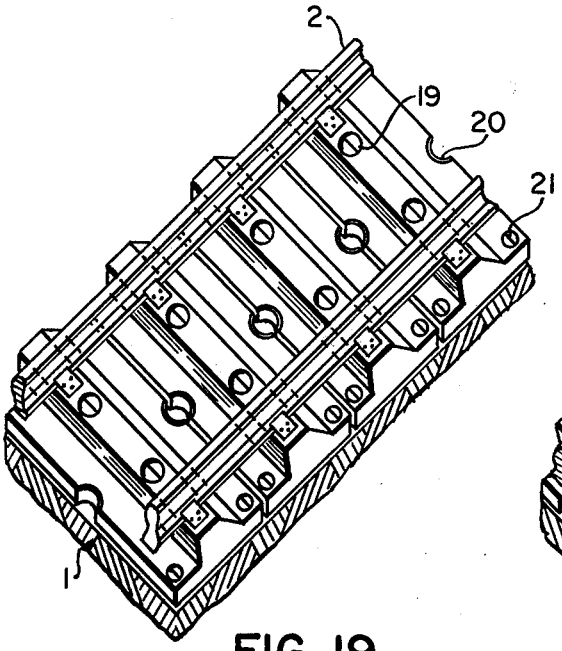
FIGS. 19 and 20 are perspective views of prefabricated units.

FIG. 19 shows in axionometry a complex of bases with one projection only of a finalized prefabricated structure.

Figure 20:
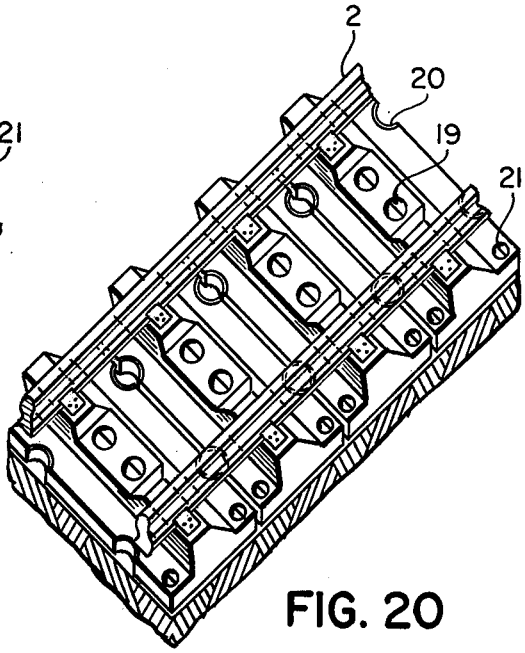

FIG. 20 indicates a complex of bases with one projection only of a completed prefabricated structure with a different transverse structure of a light type.

FIG. 21 shows a prefabricated sleeper of the light type with a single projection base, the structure of which can be in reinforced concrete, precompressed concrete or other material of high resistance as for example expanded clay and others; 45 indicates the structure; 20 the opening for the insertion of the lock 20 and parts to lighten the structure.

FIG. 21*b* shows the section of a sleeper in reinforced precompressed concrete with metal carpentry; 2 indicates the rail; 60 the structure of the base with the projection.

FIG. 22 shows a mold for the construction of a continued base; the reference numbers 46-47-48-49-50 indicate the particulars which constitute said base.

FIG. 23 shows a finalized segment of a continuous structure or sections thereof; 51 indicates the extensions of the irons of the slab.

FIG. 24 shows part of the structure in which the normal load, which exerts its weight on the dotted surface of the base, which in turn unloads itself on the structure underneath; 2 indicates the rail and 52 a segment of the projection with the base.

FIG. 25 indicates the lay-out of the metal carpentry for a single projection including the base which is applicable both to the continuous and the prefabricated structure; the reference numbers; 52-53-54 55-56-57 indicate the various shapes of the rods, while the two hooked rod crops which connect the two mechanic fastening elements are indicated with 7.

FIG. 26 shows the metal carpentry for one projection, including the base, applicable to the prefabricated structure of FIG. 20; the reference numbers 58-59-60-61-62-63 indicate different shapes of round irons, while 7 indicates two hooked rod crops, which connect the two mechanical fastening elements indicated with 5. The quoted structures have the same functions as the overturned foundation girders, and therefore the layout of the metal carpentry is applied as the one described in FIGS. 25-26.

FIG. 27 shows a segment of the supporting girder on which the rail is incorporated by means of mechanical devices. This structure permits to confer different inclinations to the rails as desired by the technicians both for the continuous as well as for the prefabricated one; 2 indicates the rail; 10 the base of the rail; 38 the supporting girders; 64 the small square; 65 the perforated bolts; 66 the calibrated wedged shim with perforations. The upper inclinations for the above-mentioned structures, can be obtained either by conferring an inclination to the molds which makes it possible to give to the structure a position in such a way that it remains in one part lower and at the other higher; or giving an inclination to the installation plane as indicated in FIG. 15.

Although the present invention has been described in the preferred embodiment, it is clear that variations can be applied without transgressing the spirit of protection of the present industrial invention.

We claim:

1. A railroad bed assembly for supporting thereon metallic railroad tracks comprising a base structure consisting essentially of reinforced concrete formed from a plurality of adjacently located prefabricated blocks, said prefabricated blocks including a slab section installed over a ground formation at a railroad bed site and at least two upwardly extending projections running transversely to said tracks each having a trapezoidal cross sectional configuration taken in a plane extending parallel to said tracks, said at least two projections and said slab being integrally formed of reinforced concrete with said at least two projections forming cross ties for supporting said tracks thereon, said slab being formed as an essentially solid continuous body between said projections, said projections having embedded therein attachment devices, said tracks being arranged to directly overlie said trapezoidal projections and being connected thereto by mechanical fastening means in gripping engagement with said tracks and connected with said attachment devices in order to hold said tracks directly on said trapezoidal projections.

2. An assembly according to claim 1 further comprising reinforcing concrete rods extending along the length of said at least two projections.

3. An assembly according to claim 2 wherein said mechanical, fastening elements include a solid support plate having a stirrup piece imbeded in said reinforced concrete material of said projection, a pair of jaws operating to attach the base of a railroad track to said projection, threaded journal boxes joined with said support plate, cooperating bolts on said plate screwed into said threaded journal boxes, said threaded journal boxes being connected beneath said support plate, a U-shaped member connected to said stirrup piece by bolts, said mechanical fastening elements operating to enable said railroad tracks to be attached to said projection with an inclination relative to the horizontal.

4. An assembly according to claim 3 further including calibrated wedged shims operating to impart inclination from the horizontal to said tracks.

5. An assembly according to claim 1 including a number of projections greater than two all integrally formed with a single unitary slab section to extend therefrom, the length of said slab section being determined in accordance with the number of said projections formed thereon.

6. An assembly according to claim 1 wherein a plurality of said projections greater than two are provided, said trapezoidal configuration being arranged with a base in proximity to said slab section which is wider than an upper portion of said projection remote from said slab section, said bases of said number of projections being spaced apart in a direction along which said tracks extend a distance which is variable in accordance with structural parameters of said assembly.

7. A assembly according to claim 6 further including a shim of antivibrating plastic material placed between said projection and a track mounted thereon.

8. An assembly according to claim 6 wherein said upper portions of said projections are spaced apart a given distance, said given distance of spacing being variable in accordance with the load requirements of said rail, the distance between said bases of said projections being variable with respect to the variation between said upper portions thereof.

9. An assembly according to claim 1 including lock means for fastening said slab sections of said prefabricated blocks into a ground formation, the number of said lock means being variable in accordance with the speed of a vehicle which is to be operated on said tracks and in accordance with the geological nature of the ground formation of said railroad bed.

* * * * *